US009444137B2

(12) United States Patent
Chang et al.

(10) Patent No.: US 9,444,137 B2
(45) Date of Patent: Sep. 13, 2016

(54) HANDHELD DEVICE

(71) Applicant: Acer Incorporated, New Taipei (TW)

(72) Inventors: Chih-Hua Chang, New Taipei (TW); Wan-Chu Wei, New Taipei (TW)

(73) Assignee: Acer Incorporated, New Taipei (TW)

( * ) Notice: Subject to any disclaimer, the term of this patent is extended or adjusted under 35 U.S.C. 154(b) by 136 days.

(21) Appl. No.: 14/334,682

(22) Filed: Jul. 18, 2014

(65) Prior Publication Data

US 2015/0270606 A1 Sep. 24, 2015

(30) Foreign Application Priority Data

Mar. 19, 2014 (TW) ..... 103110323 A

(51) Int. Cl.

| | |
|---|---|
| ***H01Q 1/48*** | (2006.01) |
| ***H01Q 1/24*** | (2006.01) |
| ***H01Q 9/42*** | (2006.01) |
| ***H01Q 21/28*** | (2006.01) |

(52) U.S. Cl.

CPC ..... *H01Q 1/48* (2013.01); *H01Q 1/243* (2013.01); *H01Q 9/42* (2013.01); *H01Q 21/28* (2013.01)

(58) Field of Classification Search

CPC ..... H01Q 1/48; H01Q 1/243

See application file for complete search history.

(56) References Cited

U.S. PATENT DOCUMENTS

| | | | | |
|---|---|---|---|---|
| 6,426,723 | B1 * | 7/2002 | Smith | H01Q 1/22 343/700 MS |
| 8,228,244 | B2 | 7/2012 | Wong et al. | |
| 8,525,740 | B2 | 9/2013 | Jeong et al. | |
| 8,786,499 | B2 * | 7/2014 | Nissinen | H01Q 1/243 343/700 MS |
| 2009/0102742 | A1 * | 4/2009 | Park | H01Q 1/2266 343/876 |
| 2011/0175795 | A1 * | 7/2011 | Toujo | G02B 1/002 343/909 |
| 2012/0229357 | A1 * | 9/2012 | Hung | H01Q 1/243 343/848 |
| 2013/0241792 | A1 * | 9/2013 | Ishikawa | H01Q 1/38 343/848 |
| 2013/0314297 | A1 * | 11/2013 | Hamabe | H01Q 21/28 343/893 |
| 2014/0132478 | A1 * | 5/2014 | Wang | H01Q 1/243 343/893 |
| 2014/0320379 | A1 * | 10/2014 | Hamabe | H01Q 21/0075 343/893 |
| 2015/0042520 | A1 * | 2/2015 | Zhao | H01Q 1/523 343/702 |

FOREIGN PATENT DOCUMENTS

| | | |
|---|---|---|
| TW | I254492 | 5/2006 |

* cited by examiner

*Primary Examiner* — Trinh Dinh
(74) *Attorney, Agent, or Firm* — Jianq Chyun IP Office

(57) ABSTRACT

A handheld device including a ground plane, a first antenna element and a second antenna element is provided. The ground plane includes a short edge and a first long edge adjacent to each other to form a first corner. The first antenna element is opposite to the short edge of the ground plane. The second antenna element is opposite to the first long edge of the ground plane and includes a first radiation portion. An end of the first radiation portion is electrically connected to the first long edge and adjacent to the first corner. The handheld device uses the second antenna element to adjust an equivalent ground plane length of the first antenna element.

7 Claims, 3 Drawing Sheets

HANDHELD DEVICE

CROSS-REFERENCE TO RELATED APPLICATION

This application claims the priority benefit of Taiwan application serial no. 103110323, filed on Mar. 19, 2014. The entirety of the above-mentioned patent application is hereby incorporated by reference herein and made a part of this specification.

BACKGROUND OF THE INVENTION

1. Field of the Invention

The invention relates to a handheld device, and particularly relates to a handheld device having an antenna element.

2. Description of Related Art

With the rapid development of communication technology, a variety of handheld devices have been continuously popularized on the market. In addition, multi-functional handheld devices, such as smart phones, tablet computers, and notebook computers, etc., provide a more convenient life to people. Currently, due to the trend in miniaturization of the handheld devices, the space in a handheld device for disposing an antenna element becomes relatively limited, resulting that the characteristic (e.g. an operation bandwidth) of the antenna element is influenced.

To improve the operation bandwidth of the antenna element, the conventional technique generally disposes a ground metal sheet which is electrically connected to a specific position of a system ground plane, and utilizes the ground metal sheet to adjust an equivalent ground plane length of the antenna element for increasing the operation bandwidth of the antenna element in a predetermined band. However, the conventional technique consumes more hardware space for additionally disposing the ground metal sheet and limits the development of the miniaturization of the handheld device.

SUMMARY OF THE INVENTION

The invention provides a handheld device, including a first antenna element and a second antenna element disposed along a short edge and a first long edge of a ground plane. In addition, the second antenna element is used to adjust an equivalent ground plane length of the first antenna element. Thus, a characteristic of the first antenna element is improved so as to facilitate the miniaturization of the handheld device.

A handheld device of the invention includes a ground plane, a first antenna element, and a second antenna element. The ground plane includes a short edge and a first long edge that are adjacent to form a first corner. The first antenna element is opposite to the short edge of the ground plane. The second antenna element is opposite to the first long edge of the ground plane. In addition, the second antenna element includes a first radiation portion. In addition, one end of the first radiation portion is electrically connected to the first long edge and adjacent to the first corner. Moreover, the handheld device uses the second antenna element to adjust an equivalent ground plane length of the first antenna element.

According to an embodiment of the invention, a sum of lengths of the first radiation portion and the short edge defines the equivalent ground plane length of the first antenna element.

Based on the above, the handheld device of the invention includes the first antenna element and the second antenna element disposed along the short edge and the first long edge of the ground plane. In addition, the ground end of the second antenna element is adjacent to the first corner formed by the intersection of the short edge and the first long edge. Moreover, the handheld device is capable of using the second antenna element to adjust an equivalent ground plane length of the first antenna element. Thus, a characteristic of the first antenna element is improved so as to facilitate the miniaturization of the handheld device.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
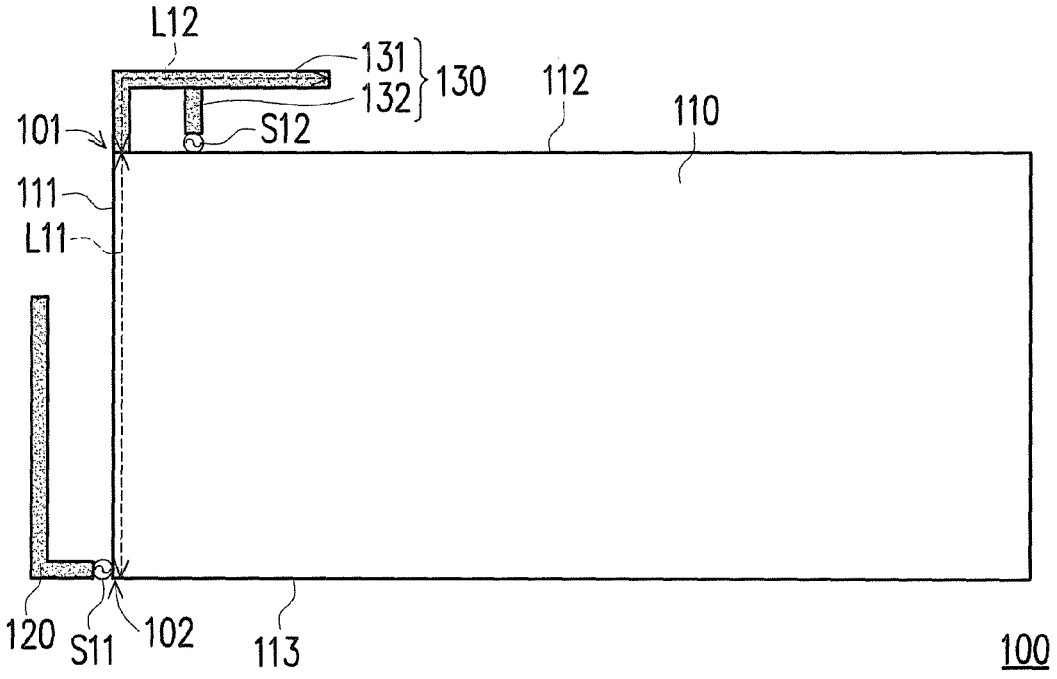
FIG. 1 is a schematic view illustrating a handheld device according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic view illustrating a handheld device according to an embodiment of the invention. As shown in FIG. 1, a handheld device 100 includes a ground plane 110, a first antenna element 120, and a second antenna element 130. In addition, the ground plane 110 includes a short edge 111, a first long edge 112, and a second long edge 113. In addition, the short edge 111 and the first long edge 112 are adjacent to and intersecting each other. In addition, the intersection of the short edge 111 and the first long edge 112 forms a first corner 101. Similarly, the short edge 111 and the second long edge 113 are adjacent to and intersecting each other. In addition, the intersection of the short edge 111 and the second long edge 113 forms a second corner 102.

In terms of configuration, the ground plane 110, the first antenna element 120, and the second antenna element 130 are located on the same horizontal plane. For example, in an embodiment, the handheld device 100 further includes a substrate (not shown), and the ground plane 110, the first antenna element 120, and the second antenna element 130 are disposed on a surface of the substrate. In addition, the first antenna element 120 is opposite to the short edge 111, and the second antenna element 130 is opposite to the first long edge 112. Namely, the first antenna element 120 is disposed along the short edge 111 of the ground plane 110, and the second antenna element 130 is disposed along the first long edge 112 of the ground plane 110.

In addition, the first antenna element 120 may be a monopole antenna. Moreover, the first antenna element 120 is electrically connected to a signal source S11 and adjacent to the second corner 102 of the ground plane 110. The second antenna element 130 includes a first radiation portion 131 and a feeding portion 132. In addition, one end of the first radiation portion 131 is electrically connected to the first long edge 112 and adjacent to the first corner 101. In other words, the second antenna element 130 has a ground end, and the ground end of the second antenna element 130 is adjacent to the first corner 101 of the ground plane 110. Furthermore, the first radiation portion 131 is electrically connected to a signal source S12 through the feeding portion 132. Accordingly, the second antenna element 130 may form a planar inverted-F antenna.

In terms of operation, the signal source S11 may provide a feeding signal to the first antenna element 120. Thus, the first antenna element 120 may generate an excitation mode and operate in a first band. In addition, the handheld device 100 may use the second antenna element 130 to adjust an equivalent ground plane length of the first antenna element 120. Thus, a characteristic of the first antenna element 120 may be improved so as to facilitate the miniaturization of the handheld device 100.

For example, when the first antenna element 120 operates, the handheld device 100 may turn off the signal source S12, such that the second antenna element 130 ceases operations (i.e. stop receiving and transmitting electromagnetic waves). In addition, as the first antenna element 120 operates, an excitation current of the first antenna element 120 is distributed on the ground plane 110. Moreover, the excitation current on the ground plane 110 is mainly concentrated in the first corner 101 and the second corner 102 of the ground plane 110. In other words, the ground end of the second antenna element 130 is adjacent to a position where the excitation current of the first antenna element 120 is the most intensive. Accordingly, the handheld device 100 may use the second antenna element 130 to adjust the equivalent ground plane length of the first antenna element 120.

In the embodiment shown in FIG. 1, a sum of lengths of the first radiation portion 131 and the short edge 111 may define the equivalent ground plane length of the first antenna element 120. Namely, if the length of the short edge 111 is L11, and the length of the first radiation portion 131 is L12, the equivalent ground plane length of the first antenna element 120 is equivalent to addition of the lengths L11 and L12. Besides, the equivalent ground plane length of the first antenna element 120 may be 0.44 to 0.46 times a wavelength of a center frequency of the first antenna element 120, for example. In other words, in an embodiment, the sum of the lengths of the first antenna portion 131 and the short edge 111 (i.e. addition of the lengths L11 and L12) may be 0.44 to 0.46 times the center frequency of the first antenna element 120, for example.

Specifically, in the embodiment shown in FIG. 1, the ground plane 110 does not have an optimal dimension for the first antenna element 120. Thus, the second antenna element 130 is disposed at an appropriate position in this embodiment. In this way, in addition to receiving and transmitting electromagnetic waves, the second antenna element 130 may also adjust the equivalent ground plane length of the first antenna element 120 on the short edge 111 to an optimal value, so as to improve the characteristic (e.g. an operation bandwidth) of the first antenna element 120.

Figure 2:
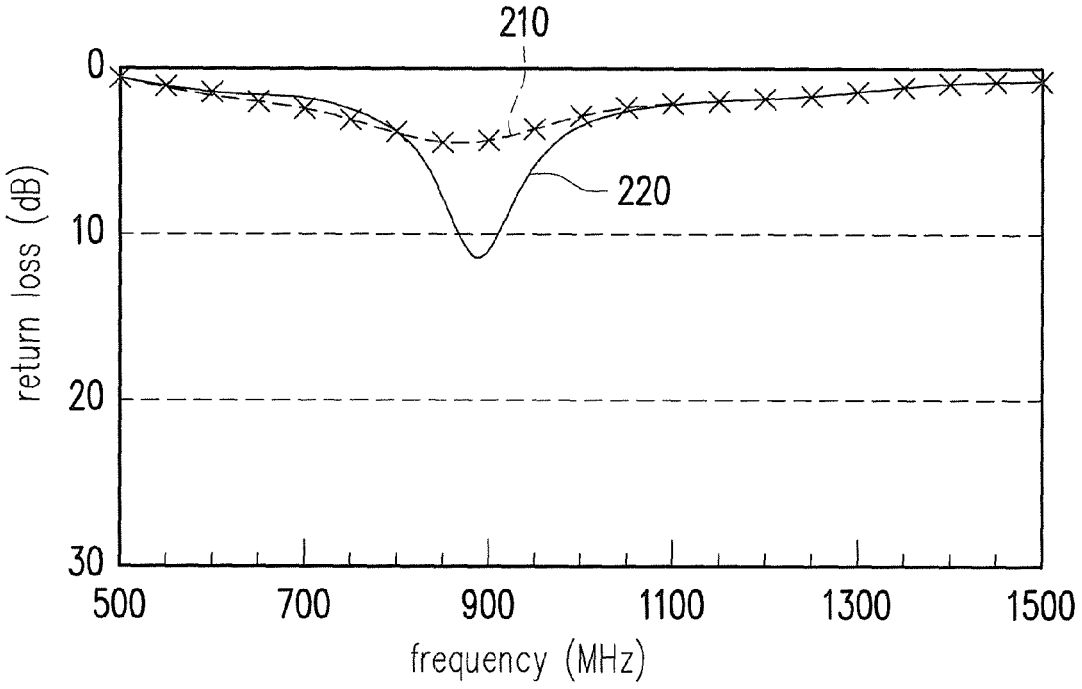
FIG. 2 is a diagram illustrating a return loss of a first antenna element according to an embodiment of the invention.
Figure 3:
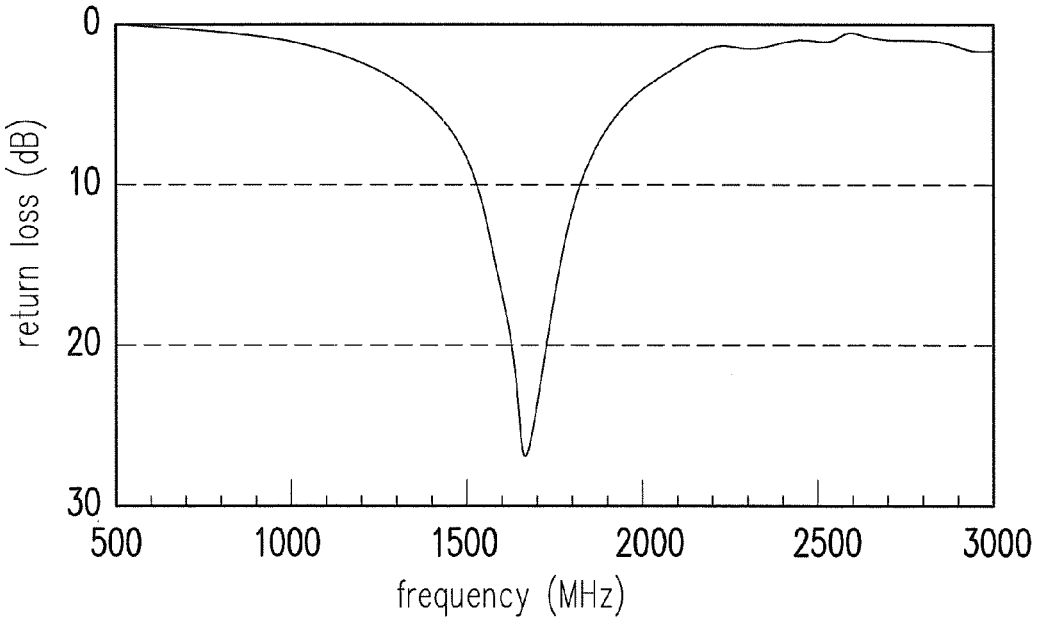
FIG. 3 is a diagram illustrating a return loss of a second antenna element according to an embodiment of the invention.
Figure 4:
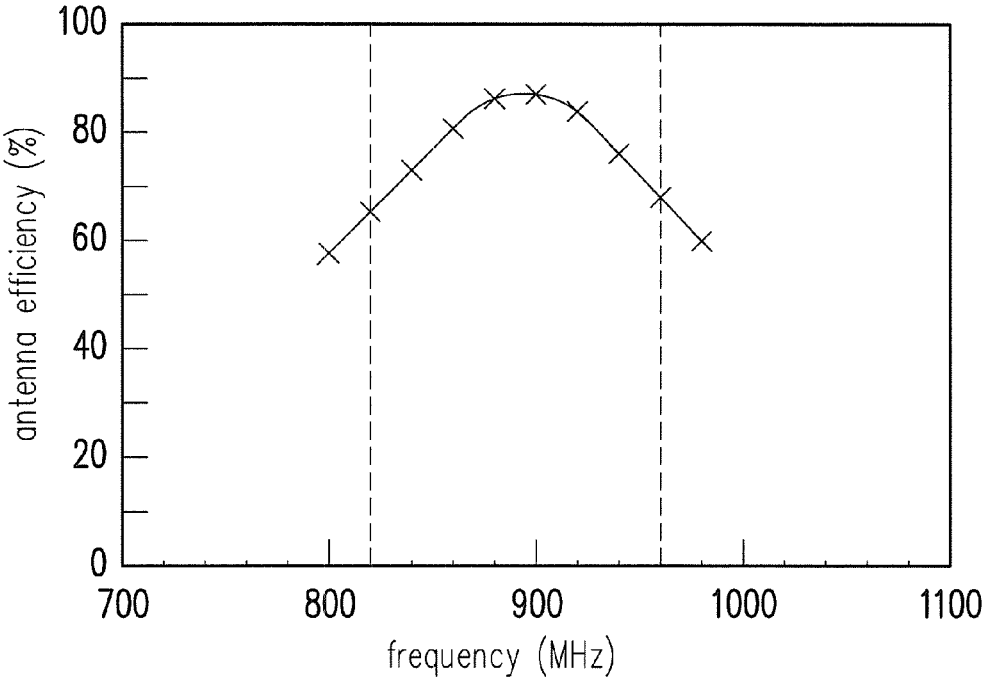
FIG. 4 is a diagram illustrating an antenna efficiency of the first antenna element according to an embodiment of the invention.

For example, FIG. 2 is a diagram illustrating a return loss of the first antenna element according to an embodiment of the invention, FIG. 3 is a diagram illustrating a return loss of the second antenna element according to an embodiment of the invention, and FIG. 4 is a diagram illustrating an antenna efficiency of the first antenna element according to an embodiment of the invention. In the embodiment shown in FIGS. 2-4, a size of the ground plane 110 is about 180×100 $mm^2$, a size of the first antenna element 120 is about 67×5 $mm^2$, and a size of the second antenna element 130 is about 53×10 $mm^2$.

As shown in FIG. 2, a return loss curve 210 represents a return loss when the second antenna element 130 is not disposed, and a return loss curve 220 represents a return loss when the second antenna element 130 is disposed. Based on the return loss curves 210 and 220, when the second antenna element 130 is not disposed, the first antenna element 120 does not have a preferable impedance matching when operating at 900 MHz. However, when the second antenna element 130 is disposed, the first antenna element 120 may cover 822 MHz to 964 MHz. In other words, the second antenna element 130 may effectively improve an operation bandwidth of the first antenna element 120 to cover a GSM 850/900 band.

Besides, the second antenna element 130 may receive and transmit electromagnetic waves. For example, as shown in FIG. 3, the second antenna element 130 may operate at approximately 1575 MHz to cover a GPS band. It should be noted that during operation, the second antenna element 130 may not improve the characteristic of the first antenna element 120. In addition, when the second antenna element 130 ceases operations, the first antenna element 120 may use the second antenna element 130 to adjust the equivalent ground plane length of the first antenna element 120 to the optimal value, so as to improve a receiving and transmitting quality. For example, as shown in FIG. 4, when the first antenna element 120 operates between 824 MHz-960 MHz, an antenna efficiency is approximately 57% to 88%, thus meeting an application requirement of the handheld device 100.

Although the embodiment shown in FIG. 1 exemplifies the first antenna element 120 and the second antenna element 130, the invention is not limited thereto. For example, the first antenna element 120 may also be a planar inverted-F antenna, a loop antenna, a dipole antenna, a slot antenna, or antennas of other configurations. In addition, the second antenna element 130 may be an antenna having a ground end, for example.

Figure 5:
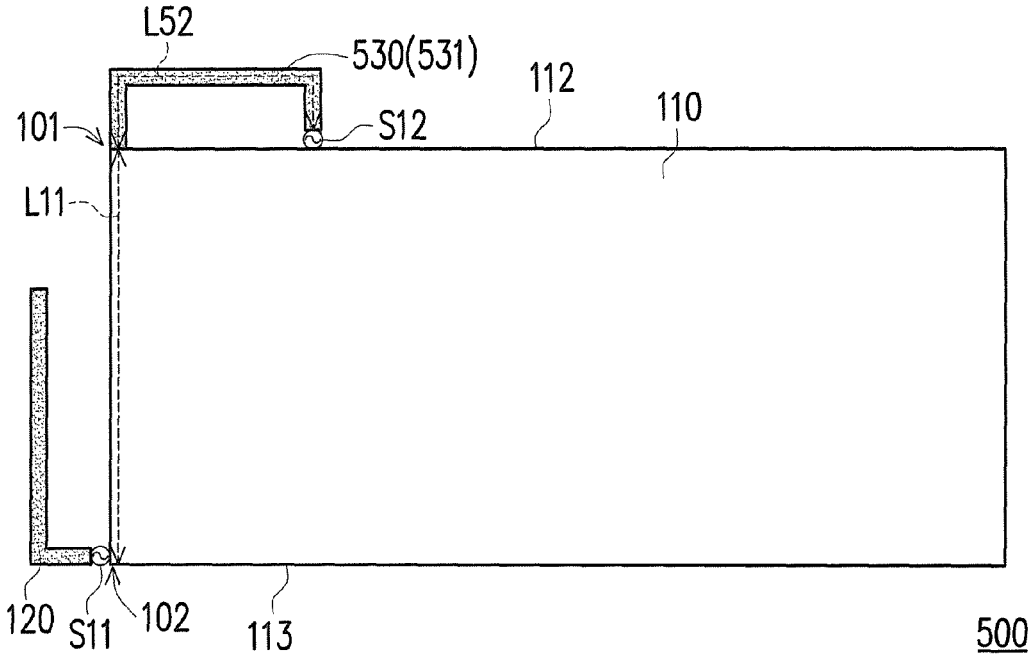
FIG. 5 is a schematic view illustrating a handheld device according to another embodiment of the invention.

For example, FIG. 5 is a schematic view illustrating a handheld device according to another embodiment of the invention. A handheld device 500 shown in FIG. 5 is similar to the handheld device 100 shown in FIG. 1. A difference from FIG. 1 is that a second antenna element 530 shown in FIG. 5 is composed of a first radiation portion 531.

Specifically, one end of the first radiation portion 531 is electrically connected to the first edge 112 and adjacent to the first corner 101, and the other end of the first radiation portion 531 is electrically connected to the signal source S12. Therefore, the second antenna element 530 may form a loop antenna. In addition, a sum of lengths of the first radiation portion 531 and the short edge 111 may define the equivalent ground plane length of the first antenna element 120. Namely, if the length of the first antenna portion 531 is L52, the equivalent ground plane length of the first antenna element 120 is equivalent to addition of the lengths L11 and L52.

In addition, similar to the embodiment shown in FIG. 1, when the first antenna element 120 operates, the second antenna element 530 may cease operations (i.e. stop receiving and transmitting electromagnetic waves). At this time, the handheld device 500 may use the second antenna element 530 to adjust the equivalent ground plane length of the first antenna element 120, so as to improve the characteristic of the first antenna element 120. Besides, the second antenna element 531 may perform an operation for receiving and transmitting electromagnetic waves. At this time, the second antenna element 530 does not improve the characteristic of the first antenna element 120. Detailed description regarding the components in FIG. 5 is already provided in the description of the embodiments above, so no further details will be reiterated hereinafter.

Figure 6:
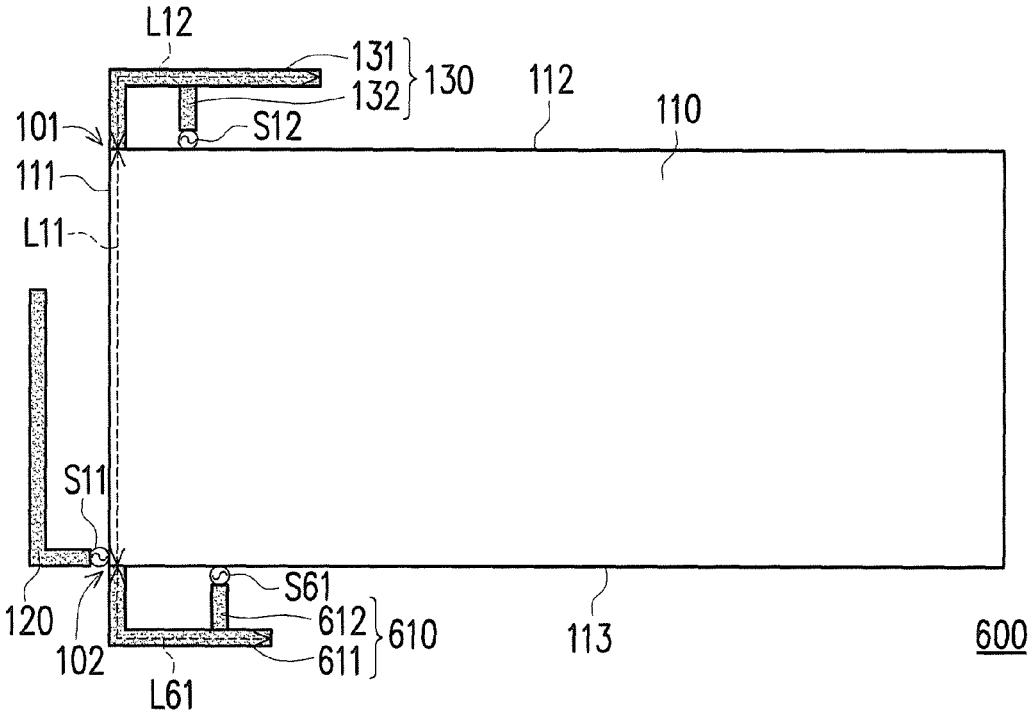
FIG. 6 is a schematic view illustrating a handheld device according to yet another embodiment of the invention.

FIG. 6 is a schematic view illustrating a handheld device according to yet another embodiment of the invention. A handheld device 600 shown in FIG. 6 is similar to the handheld device 100 shown in FIG. 1. A difference from FIG. 1 is that a handheld device 600 shown in FIG. 6 further includes a third antenna element 610.

Specifically, the third antenna element 610 is opposite to the second long edge 113. Namely, the third antenna element 610 is disposed along the second long edge 113 of the ground plane 110. In addition, the third antenna element 610 includes a second radiation portion 611 and a feeding portion 612. Moreover, one end of the second radiation portion 611 is electrically connected to the second long edge 113 and adjacent to the second corner 102. In other words, the third antenna element 610 has a ground end, and the ground end of the third antenna element 610 is adjacent to the second corner 102 of the ground plane 110. Furthermore, the second radiation portion 611 is electrically connected to a signal source S61 through the feeding portion 612. Accordingly, the third antenna element 610 may form a planar inverted-F antenna.

In terms of operation, when the first antenna element 120 operates, the handheld device 600 may turn off the signal sources S12 and S61, such that the second antenna element 130 and the third antenna element 610 cease operations (i.e. stop receiving and transmitting electromagnetic waves). In addition, the ground ends of the second antenna element 130 and the third antenna element 610 are adjacent to the position where the excitation current of the first antenna element 120 is the most intensive. Accordingly, the handheld device 600 may use the second antenna element 130 and the third antenna element 610 to adjust the equivalent ground plane length of the first antenna element 120. Thus, a characteristic of the first antenna element 120 may be improved so as to facilitate the miniaturization of the handheld device 600.

In the embodiment shown in FIG. 6, a sum of the lengths of the first radiation portion 131, the second radiation portion 611, and the short edge 111 may define the equivalent ground plane length of the first antenna element 120. Namely, if a length of the second antenna portion 611 is L61, the equivalent ground plane length of the first antenna element 120 is equivalent to addition of the lengths L11, L12 and L61. Besides, the equivalent ground plane length of the first antenna element 120 may be 0.44 to 0.46 times the wavelength of the center frequency of the first antenna element 120, for example.

In other words, in an embodiment, the sum of the lengths of the first radiation portion 131, the second radiation portion 611, and the short edge 111 may be 0.44 to 0.46 times the wavelength of the center frequency of the first antenna element 120, for example. Besides, the second antenna element 130 and the third antenna element 610 may respectively receive and transmit electromagnetic waves. At this time, the second antenna element 130 and the third antenna element 610 do not improve the characteristic of the first antenna element 120. In addition, similar to the embodiment shown in FIG. 5, the third antenna element 610 may also be directly composed of the first antenna portion, and the other end of the first radiation portion may be directly electrically connected to the signal source S61, such that the third antenna element 610 forms a loop antenna. Detailed description regarding the components in FIG. 6 is already provided in the description of the embodiments above, so no further details will be reiterated hereinafter.

In view of the foregoing, the handheld device of the invention includes the first antenna element and the second antenna element disposed along the short edge and the first long edge of the ground plane. In addition, the ground end of the second antenna element is adjacent to the first corner formed by the intersection of the short edge and the first long edge. Therefore, the second antenna element may adjust the equivalent ground plane length of the first antenna element, in addition to receiving and transmitting electromagnetic waves, so as to improve the characteristic (e.g. the operation bandwidth) of the first antenna element. In other words, the invention improves the characteristic of the first antenna element without additionally disposing a ground metal sheet, thus facilitating the miniaturization of the handheld device.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A handheld device, comprising:

a ground plane, comprising a short edge, a first long edge that are connected to form a first corner, and a second long edge connected to the short edge to form a second corner;

a first antenna element, opposite to the short edge and connected to the second corner;

a second antenna element, opposite to the first long edge and comprising a first radiation portion, wherein one end of the first radiation portion is electrically connected to the first long edge and connected to the first corner; and a third antenna element, opposite to the second long edge and comprising a second radiation portion, wherein one end of the second radiation portion is electrically connected to the second long edge and connected to the second corner, wherein the handheld device uses the second antenna element and the third antenna element to adjust an equivalent ground plane length of the first antenna element to be a sum of lengths of the first radiation portion, the second radiation portion and the short edge to adjust an operation bandwidth of the first antenna element.

2. The handheld device as claimed in claim 1, wherein in the operation of the handheld device uses the second antenna element to adjust the equivalent ground plane length of the first antenna element, the handheld device turns off the second antenna element when the first antenna element operates.

3. The handheld device as claimed in claim 1, wherein the equivalent ground plane length of the first antenna element is 0.44 to 0.46 times a wavelength of a center frequency of the first antenna element.

4. The handheld device as claimed in claim 1, wherein the second antenna element is a planar inverted-F antenna or a loop antenna.

5. The handheld device as claimed in claim 1, wherein when the first antenna element operates, the second antenna element and the third antenna element cease operations.

6. The handheld device as claimed in claim 1, wherein a sum of lengths of the first radiation portion, the second radiation portion and the short edge defines the equivalent ground plane length of the first antenna element.

7. The handheld device as claimed in claim 1, wherein the ground plane, the first antenna element, and the second antenna element are located on the same horizontal plane.

* * * * *